United States Patent [19]

Black

[11] 3,964,116

[45] June 22, 1976

[54] SCAFFOLD SUPPORTING DEVICE

[76] Inventor: Don Black, 1256 E. 13th St., Brooklyn, N.Y. 11230

[22] Filed: Aug. 7, 1975

[21] Appl. No.: 602,637

[52] U.S. Cl. ..... 9/1.7; 108/152; 182/82; 248/225; 248/228; 248/235

[51] Int. Cl.[2] ..... E04G 3/04

[58] Field of Search ..... 9/1 C, 1 D; 248/73, 248/223, 225, 228, 235, 241, 247, 250; 108/152; 182/82, 134

[56] References Cited

UNITED STATES PATENTS

| | | | |
|---|---|---|---|
| 493,216 | 3/1893 | Louden | 248/228 |
| 2,961,270 | 11/1960 | Renfroe | 248/228 |
| 3,472,475 | 10/1969 | Rudiger | 248/228 |
| 3,660,871 | 5/1972 | Boyle | 182/82 |
| 3,822,000 | 7/1974 | Maeda | 182/82 |

*Primary Examiner*—Duane A. Reger
*Assistant Examiner*—Charles E. Frankfort

[57] ABSTRACT

Each of a pair of clip members comprises a plate-type member of rectangular configuration having a rectangular corner cutout forming a pair of perpendicular edges. Each clip member has a channel formed therein and extending perpendicularly to one of the edges and linearly with the other of the edges for accommodating the ledge part of a stiffener of a ship's hull and bulkhead with one of the edges abutting the underside of the plank-type part of the stiffener. A pair of bracket members support a scaffold platform between them. Each bracket member comprises a plate-type member having a rectangular part tapering downward to a narrow part and a rectangular corner cutout in the rectangular part forming a pair of perpendicular edges. Each bracket member is releasably affixed to a corresponding bracket member in a manner whereby one of the edges of the bracket member abuts the topside of the plank-type part of the stiffener and the other of the edges of the bracket member abuts the outside of the ledge part of the stiffener thereby securing the clip members to the stiffener.

2 Claims, 2 Drawing Figures

SCAFFOLD SUPPORTING DEVICE

DESCRIPTION OF THE INVENTION:

The present invention relates to a scaffold supporting device. More particularly, the invention relates to a scaffold supporting device for a ship's hull having bulkheads and stiffeners affixed to and extending from the inside surfaces of the hull and from the bulkheads.

Objects of the invention are to provide a scaffold supporting device of simple structure, which is inexpensive in manufacture, installed and removed with facility, rapidity and convenience, safe, strong and sturdy in use, conveniently installed on existing stiffeners, and functions efficiently, effectively and reliably.

Figure 2:
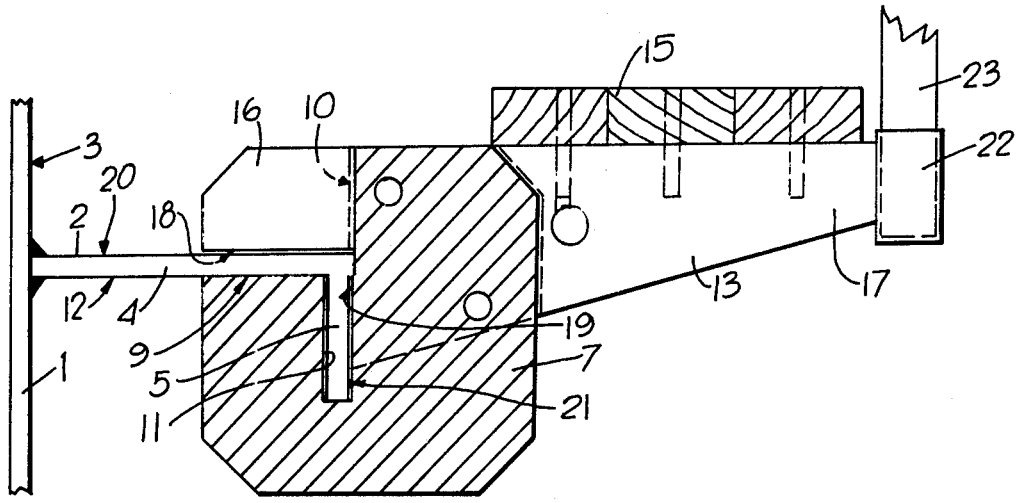
Figure 1:
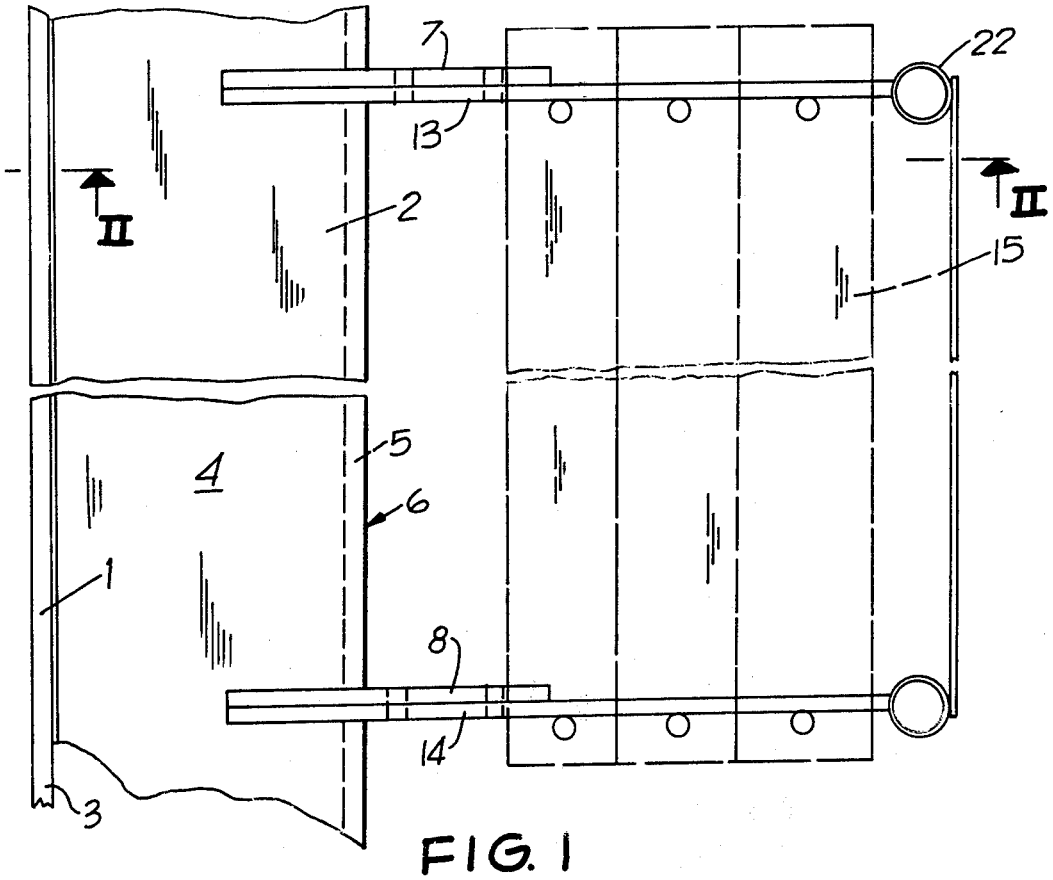

In order that the invention may be readily carried into effect, it will now be described with reference to the accompanying drawing, wherein:

FIG. 1 is a top view of an embodiment of the scaffold supporting device of the invention; and FIG. 2 is a view, taken along the lines II—II, of FIG. 1.

In FIG. 2, the clip member is cross-hatched in order to illustrate its configuration. The cross-hatching lines do not denote a cross-section of the clip member. In FIG. 2, only the scaffold platform is shown in section.

The scaffold supporting device of the invention is for a ship's hull 1 having bulkheads, not shown in the FIGS., and stiffeners, of which one stiffener 2 is shown in the FIGS., affixed to, and extending from, the inside surfaces, of which one surface 3 is shown in the FIGS., of the hull or from the bulkheads. Each stiffener comprises a plank-type part 4 affixed to the hull or bulkheads and a ledge part 5 extending downward from the free edge 6 of the plank-type part and substantially perpendicularly therefrom.

The scaffold supporting device of the invention comprises a pair of clip members 7 and 8. Each clip member, as illustrated for the clip member 7, comprises a plate-type member of substantially rectangular configuration having a substantially rectangular corner cutout forming a pair of substantially perpendicular edges 9 and 10. A channel 11 is formed in the clip member 7 and extends substantially perpendicularly to the edge 9 and substantially linearly with the edge 10 for accommodating the ledge part 5 of the stiffener 2 with the edge 9 abutting the underside 12 of the plank-type part 4 of the stiffener.

The scaffold supporting device of the invention further comprises a pair of bracket members 13 and 14. The bracket members 13 and 14 support a scaffold platform 15 between them. Each bracket member, as illustrated for the bracket member 13, comprises a plate-type member having a substantially rectangular part 16 tapering downward to a narrow part 17. The bracket member has a substantially rectangular corner cutout in the rectangular part 16 forming a pair of substantially perpendicular edges 18 and 19.

Fastening devices such as, for example, nuts and bolts, not shown in the FIGS., releasably affix a bracket member 13 to a clip member 7 in a manner whereby the edge 18 of the bracket member 13 abuts the topside 20 of the plank-type part 4 of the stiffener and the other edge 19 of the bracket member abuts the outside 21 of the ledge part 5 of the stiffener, thereby securing the clip members to the stiffener.

Each bracket member has a socket 22 for supporting a rail post 23 extending from the narrow end 17 thereof.

While the invention has been described by means of a specific example and in a specific embodiment, I do not wish to be limited thereto, for obvious modifications will occur to those skilled in the art without departing from the spirit and scope of the invention.

I claim:

1. A scaffold supporting device for a ship's hull having bulkheads, stiffeners affixed to and extending from the inside surfaces of the hull and from the bulkheads, each stiffener comprising a plank-type part affixed to the hull and bulkheads and a ledge part extending downward from the free edge of the plank-type part, said scaffold supporting device comprising a pair of clip members, each comprising a plate-type member of substantially rectangular configuration having a substantially rectangular corner cutout forming a pair of substantially perpendicular edges and a channel formed therein and extending substantially perpendicularly to one of the edges and substantially linearly with the other of the edges for accommodating the ledge part of a stiffener of the hull and bulkhead with said one of the edges abutting the underside of the plank-type part of the stiffener;

a pair of bracket members for supporting a scaffold platform between them, each comprising a plate-type member having a substantially rectangular part tapering downward to a narrow part and a substantially rectangular corner cutout in the rectangular part forming a pair of substantially perpendicular edges; and fastening means for releasably affixing a bracket member to a clip member in a manner whereby one of the edges of the bracket member abuts the topside of the plank-type part of the stiffener and the other of the edges of the bracket member abuts the outside of the ledge part of the stiffener thereby securing the clip members to the stiffener.

2. A scaffold supporting device as claimed in claim 1, wherein each bracket member has a socket for supporting a rail post extending from the narrow end thereof.

* * * * *